US006598542B2

(12) United States Patent
Goldberg et al.

(10) Patent No.: US 6,598,542 B2
(45) Date of Patent: Jul. 29, 2003

(54) INTERCONNECTABLE TABLE SYSTEM

(75) Inventors: Neil J. Goldberg, San Francisco, CA (US); Imraan Aziz, Stanford, CA (US); Vincent M. DiPalma, San Francisco, CA (US); Elliott W. Baum, Maryland Heights, MO (US); Lucian N. Chirea, St. Louis, MO (US); Richard O. Berkowitz, St. Louis, MO (US)

(73) Assignee: Berco Industries, Inc., St. Louis, MO (US)

( * ) Notice: Subject to any disclaimer, the term of this patent is extended or adjusted under 35 U.S.C. 154(b) by 0 days.

(21) Appl. No.: 09/854,538

(22) Filed: May 14, 2001

(65) Prior Publication Data

US 2002/0166482 A1 Nov. 14, 2002

(51) Int. Cl.[7] ..... A47B 57/00
(52) U.S. Cl. ..... 108/64; 403/113
(58) Field of Search ..... 108/64, 65; 403/119, 403/112, 113, 95, 83

(56) References Cited

U.S. PATENT DOCUMENTS

| | | | | |
|---|---|---|---|---|
| 154,580 | A | 9/1874 | Buckner, Jr. | |
| 1,034,499 | A | 8/1912 | Payne | |
| 1,061,855 | A | 5/1913 | Lobo | |
| 1,520,518 | A | * 12/1924 | Thomason | 108/64 |
| 3,342,147 | A | 9/1967 | Shettles | |
| 3,425,721 | A | 2/1969 | Agee | |
| 3,521,579 | A | 7/1970 | Stafford | |
| 3,703,870 | A | * 11/1972 | Walton | 108/51.11 |
| 3,826,206 | A | 7/1974 | Ruggles | |
| 4,158,335 | A | 6/1979 | Belcastro, deceased et al. | |
| 4,187,786 | A | 2/1980 | Feig et al. | |
| 4,479,575 | A | 10/1984 | Gründken et al. | |
| 4,493,583 | A | 1/1985 | Wallace | |
| 4,675,929 | A | 6/1987 | Santo | |
| 4,900,193 | A | 2/1990 | MacKinnon | |
| 5,090,835 | A | 2/1992 | Cox | |
| 5,149,236 | A | 9/1992 | Rapayelian | |
| 5,182,996 | A | 2/1993 | Gutgsell | |
| 5,339,747 | A | 8/1994 | Epps | |
| 5,372,450 | A | 12/1994 | Blodgett | |
| 5,380,119 | A | 1/1995 | Hadden | |
| 5,483,900 | A | 1/1996 | Elzenbeck | |
| 5,547,307 | A | 8/1996 | Decore et al. | |
| 5,560,302 | A | 10/1996 | Diffrient et al. | |
| 5,794,545 | A | 8/1998 | McDaniel et al. | |
| 5,988,077 | A | * 11/1999 | Balderi | 108/64 |
| 6,047,648 | A | 4/2000 | Alm et al. | |
| 6,085,668 | A | * 7/2000 | Kanki | 108/64 |
| 6,397,762 | B1 | * 6/2002 | Goldberg et al. | 108/50.02 |
| 6,497,184 | B1 | * 12/2002 | Whitesitt | 108/64 |

FOREIGN PATENT DOCUMENTS

| | | |
|---|---|---|
| CH | 675816 | * 11/1990 |
| DE | 25 07 496 | * 8/1976 |

OTHER PUBLICATIONS

Bruce Nussbaum, *A Shape–Shifter in the Office*, Business Week Online, viewed Mar. 21, 2001, 2 pages, www.businessweek.com:/1999/99$_{13}$ 23/b3632050.htm.
Bretford Manufacturing, Inc., *metamobile meeting solutions*, product catalogue, 1999, England.
Bretford Manufacturing, Inc., *Tabling Solutions*, no date, England, admitted prior art.
Boom Kantoorprojecten, displaying the Haworth Escale and Nomade furniture line, www.kantoormeubilair.nl/Haworth%20Escale.htm, viewed Jan. 25, 2002, 5 pages, Haworth Escale design admitted prior art.

* cited by examiner

*Primary Examiner*—Janet M. Wilkens
(74) *Attorney, Agent, or Firm*—Paul M. Denk

(57) ABSTRACT

A table interconnection system includes a connector with two or more end portions sized and shaped for engagement with connection receptacles formed in adjacent tables. The connection receptacles each receive an end portion to retain the adjacent tables in a self-retained orientation. The connection receptacles and connector are located at the table surface in full view of a user, so the user can readily appreciate how the tables interconnect. Moreover, adjacent tables may be pivoted with respect to one another by direct manipulation of the table only, without disconnecting or contacting the connector.

18 Claims, 10 Drawing Sheets

INTERCONNECTABLE TABLE SYSTEM

BACKGROUND OF THE INVENTION

This invention generally relates to tables and more particularly to a system of tables that can be selectively interconnected.

The invention is especially concerned with tables designed to be connected in a variety of orientations and arrangements to enhance their overall usefulness. Office, school and business environments frequently utilize interconnected tables of this type where multiple tables joined together will use space more efficiently, create larger work areas or manage flow about a room. Conventionally, interconnectable tables connect with one another via connection apparatus semi-permanently affixed to the underside of adjacent tables. Once the tables are placed in the proper orientation, mounting brackets or other apparatus on the underside of each adjacent table to fix the position and orientation of adjacent tables. In order to connect tables together it is necessary to reach under the table to close a latch or similar device. Visual confirmation of the connection is difficult because one must view the underside of the table. In many instances the connection can be made with the tables in only one relative position.

SUMMARY OF THE INVENTION

Among the several objects and features of the present invention may be noted the provision of an interconnectable table system which permits easy and quick interconnection of tables; the provision of such a table system including a connector which is readily accessible; the provision of such a table system in which the connector is free of permanent connection to the tables; the provision of such a table system which readily permits visual confirmation of connection of tables; the provision of such a table system which allows the tables to be interconnected at different angles or in an aligned configuration relative to each other; and the provision of such a table system which permits the angle between the tables to be changed without removal of the connector.

Generally, an interconnectable table system constructed according to the principles of the present invention comprises at least two tables each comprising a table top and a support holding the table top spaced above a floor. The table top provides a work surface and has at least one connection receptacle therein. A connector for connecting the tables together has first and second end portions, each portion sized and shaped for reception in the connection receptacle of a respective one of the tables for connecting the tables together. A cross piece of the connector connects the first and second end portions and extending between the tables.

In another aspect of the present invention, a table connection system comprises a connector and connection receptacles adapted for mounting in a upwardly facing surface of a table. The connector has end portions sized and shaped for reception in the connection receptacles upon downward movement of the connector into the receptacles so that the connector secures the receptacles to each other.

Other objects and features will be in part apparent and in part pointed our hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
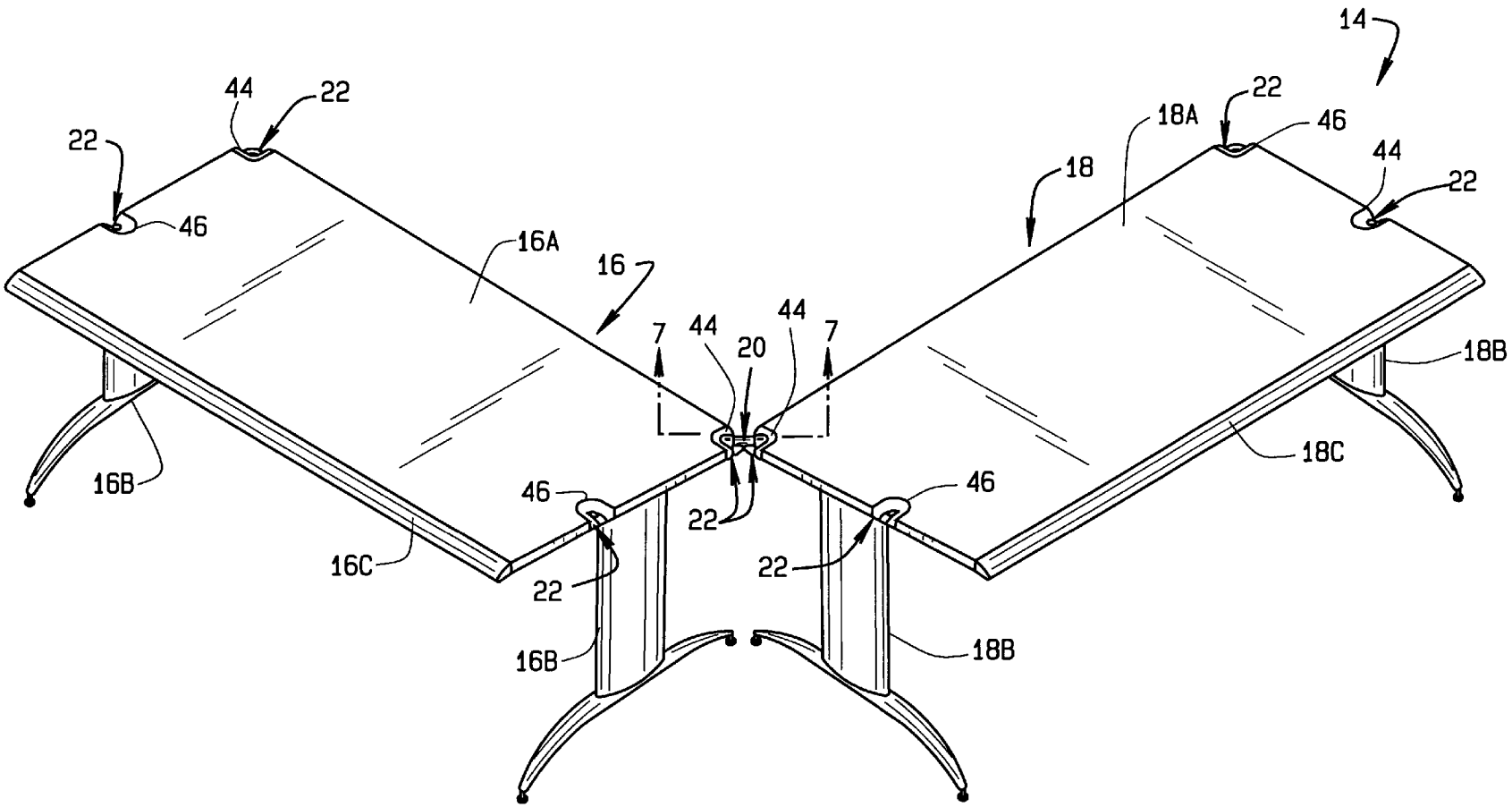
FIG. 1 is a perspective of an interconnectable table system of the present invention including two tables.

Referring now to the drawings and specifically to FIG. 1, an interconnectable table system of the present invention is generally indicated at 14. The table interconnection system readily connects two adjacent tables (designated generally by 16 and 18, respectively) to hold the tables in self-retaining position relative one another. In general, the system comprises a connector 20 engageable with connection receptacles 22 mounted in respective tables 16, 18 (the reference numerals designating their subjects generally). The connector 20 and connection receptacles 22 cooperate to retain the adjacent tables 16, 18 in a self-retained orientation and position with respect to one another, and constitute a table interconnection system. The details of this interconnection will be discussed in greater detail below.

The tables 16, 18 of the preferred embodiment are rectangular. Each table includes a table top 16A, 18A having a flat work surface, legs 16B, 18B holding the table top spaced above a floor and multiple trim pieces 16C mounted on the table edges for finishing the table. Tables (not shown) of different shape or dimension are also contemplated as within the scope of the present invention. Such table shapes may include, but are not limited to, round, oval, semicircular, triangular, etc. Other articles, such as file cabinets, shelving units, desks, bookcases, seating surfaces, etc., may also be readily adapted to interconnect with each other according to the present invention.

Figure 2:
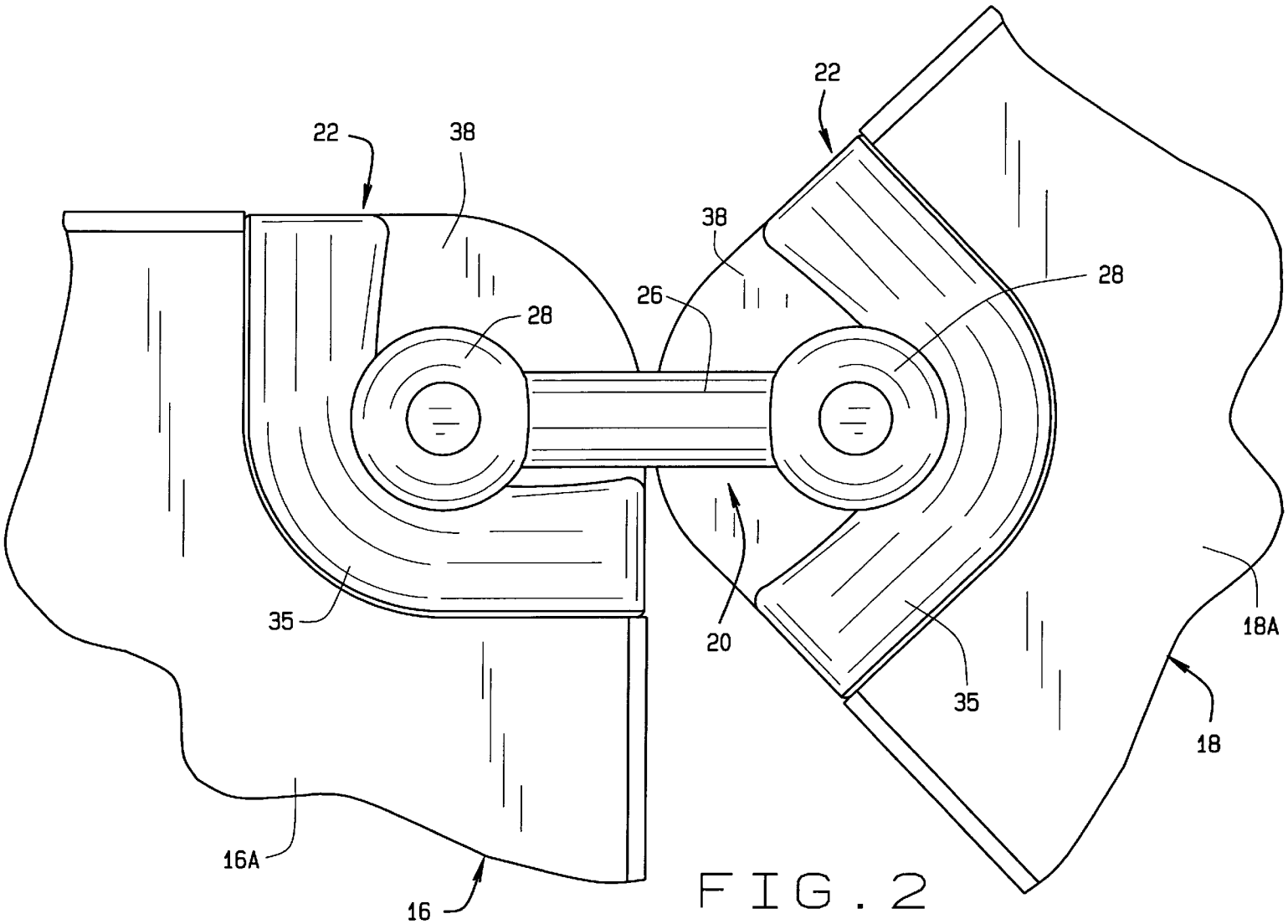
FIG. 2 is an enlarged fragmentary plan view of the system of FIG. 1 at a corner where the tables are connected.

Referring now to FIG. 2, the connector 20 of the present invention is shown attached to two adjacent tables 16, 18. The connector 20 includes a cross piece 26 interconnecting two end portions 28. The end portions and cross piece 26 are preferably of unitary construction, such as a molded plastic, decreasing the cost and complexity of manufacturing the connector 20. The connector is sized and shaped for engagement with the connection receptacles 22 mounted in the adjacent tables 16, 18. The connector 20 is symmetrical about Axis A (FIG. 4), having identical end portions 28 ready for engagement with any of the connection receptacles 22 found about the table perimeter.

Figure 3:
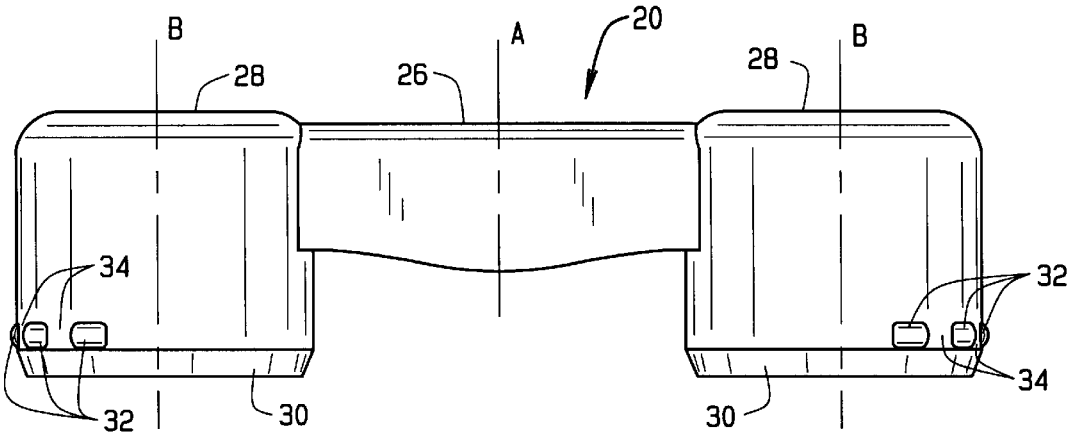
FIG. 3 is a front elevation of a connector of the present invention.
Figure 4:
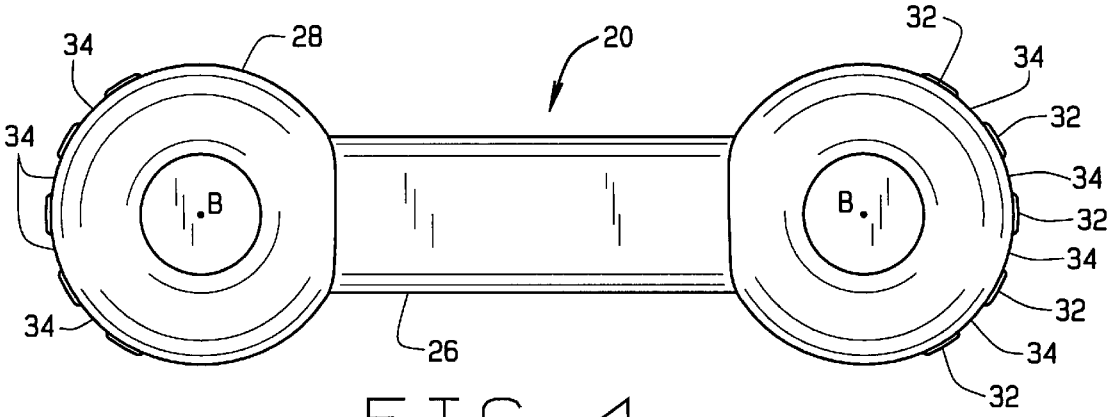
FIG. 4 is a top plan view of the connector of FIG. 3.

The end portions 28 are generally cylindrical in shape, as shown in FIGS. 3 and 4, matching the shape of the connection receptacles 22, as discussed below. The end portions 28 of the connector 20 have a circumferential chamfer 30 at their bottoms. This chamfer 30 helps align the connector 20 with the connection receptacle 22 and guides the connector into the connection receptacle during insertion. The end portions 28 have five protuberances 32 angularly spaced about each end portion just above the chamfer 30. The number of protuberances 32 can be other than five (and as few as one) without departing from the scope of the present invention. The protuberances 32 are arranged along an arc extending circumferentially about the end portion 28. Adjacent pairs of protuberances 32 define four recesses 34. These recesses are sized and shaped to engage features of the connection receptacle 22, as will be discussed in greater detail below. The connector 20 is preferably formed from a molded plastic material. Such material provides adequate wear resistance and strength, while reducing the production cost of the connector 20. Other materials with similar functional characteristics are also contemplated as within the scope of the present invention. The outer surface of the connector 20 is textured to provide a good gripping surface for the user.

Figure 5:
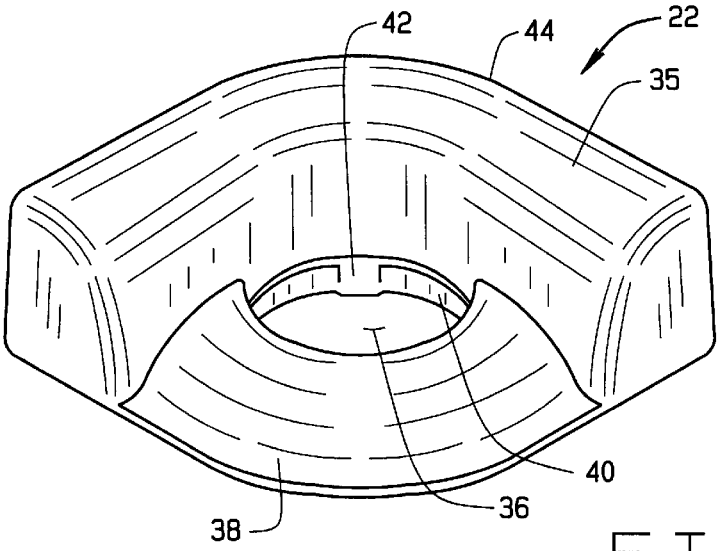
FIG. 5 is a perspective view of a corner connection receptacle of the present invention.
Figure 6:
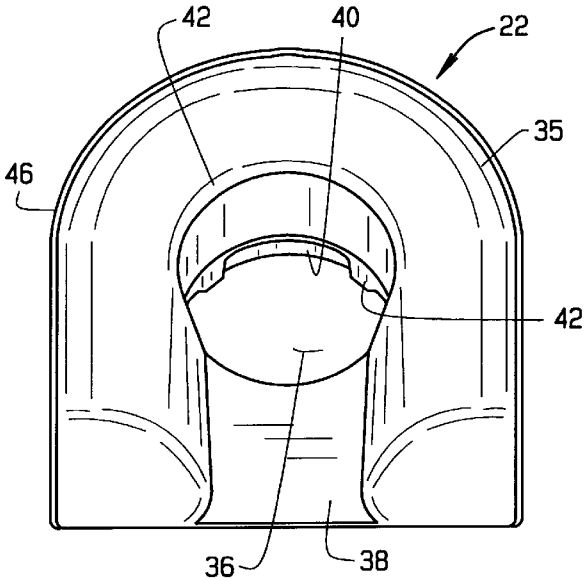
FIG. 6 is a perspective view of a transverse edge connection receptacle of the present invention.
Figure 7:
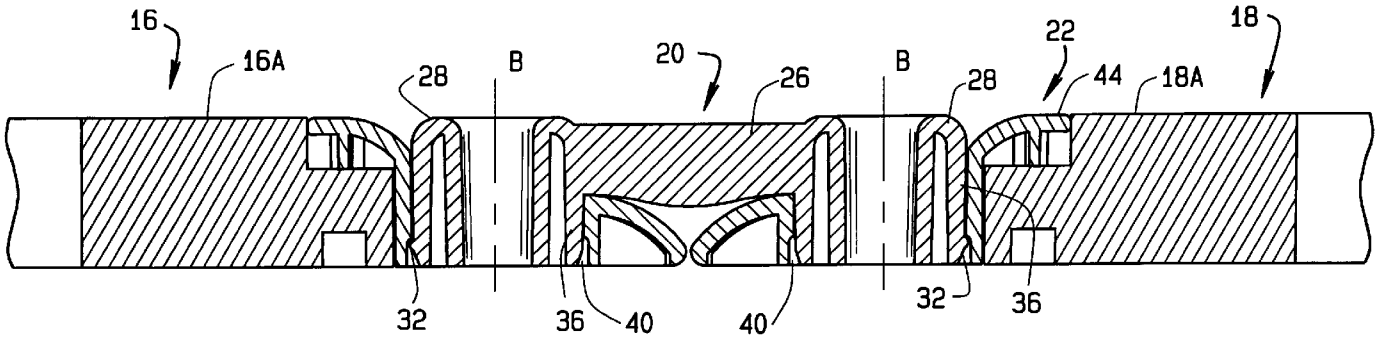
FIG. 7 is a fragmentary section of the connector as received in connection receptacles taken in the plane including line 7—7 of FIG. 1.

Referring now to FIGS. 5–7, connection receptacles 22 sized and shaped for receiving an end portion 28 of the connector 20 are shown. The receptacles 22 open upwardly at the work surface (16A or 18A) of the table top (16 or 18) and each comprise a molded plastic, bowl-shaped body 35. A cylindrical hole 36 defined in the body 35 is sized and shaped for engaging the cylindrical end portions 28 of the connector 20. The end portion of the connector 20 is receivable downwardly into the receptacle 22 through the work surface 16A, 18A of the table top 16, 18. The connection receptacle 22 includes a laterally opening race 38 that provides adequate clearance for the cross piece 26 of the inserted connector 20. The width of the race 38 determines the angular freedom of movement of the connector 20 with respect to the connection receptacle. The connection receptacles 22 further include a circumferential groove 40 about the bottom of the cylindrical hole 36 of the connection receptacle. The circumferential groove 40 of the cylindrical hole 36 and protuberances 32 of the connector 20 cooperate to create an interference fit between the two parts (FIG. 7). A user inserting the end portion 28 into the connection receptacle 22 will feel an increase in resistance as the protuberances 32 engage the cylindrical hole and a decrease in resistance when the protuberances come into registration with the groove 40. The connector 20 is held in the connection receptacle 22 by engagement of the protuberances 32 in the groove 40 against upward movement out of the connection receptacle. However, it is possible to provide a sufficient upward force on the connecter 20 to deform the protuberances 32 and the body 35 so that the connector may be removed from the receptacle.

The groove 40 includes additional features to enhance the usefulness of the interconnection system. Within the groove, a boss 42 is disposed to define further the angular orientation of the connector 20 (FIG. 5). The number of bosses can be other than one (e.g., two (FIG. 6)) without departing from the scope of the present invention. The boss 42 is sized and shaped to cooperate with the recesses 34 of the connector 20 to hold the table (16 or 18) and connector in a self-retaining angular orientation. The end portion 28 may pivot within the hole 36 of the receptacle, such as when pivoting an adjacent table to change the angle of orientation of tables 16, 18. The engagement of the boss 42 with one of the protuberances 32 in the hole 36 creates a tactile and audible response indicating the angular orientation of the connector and tables 16, 18. Although the connector 20 may be adjusted continuously within the connection receptacle 22, the increased resistance where the boss 42 engages the protuberance 32 and the decreased resistance where the boss engages the recess 34 provides feedback to the user concerning the angular orientation of the connector. Visual indicators (not shown) may also be molded into or otherwise placed upon the connector 20 and the connection receptacle 22 to further indicate orientation of the tables 16, 18 to the user.

The tables 16, 18 of the present invention include two types of connection receptacles 22, corner connection receptacles 44 (FIG. 5) and transverse edge connection receptacles 46 (FIG. 6). Corner connection receptacles 44 mount on the corner of the tables 16, 18, while transverse edge connection receptacles 46 mount at any location along a table edge. Other locations for connection receptacles 22 are also contemplated as within the scope of the present invention. For instance, a connection receptacle may be located along an arcuate edge of a round or semicircular table, or at a table corner with transverse and long edges converging at some angle other than ninety degrees (not shown). In the preferred embodiment, each of the tables 16, 18 has corner connection receptacles 44 in two corners of the table (FIG. 1). The laterally opening races 38 of the corner connection receptacles 44 extend over a ninety degree arc permitting reception of the cross piece 26 of the connector 30 into the receptacle at a greater number of angles (FIG. 5). The laterally opening race 38 of the transverse edge connection receptacles 46 is only somewhat larger than the width of the cross piece 26 of the connector 20, thereby holding the connector at a right angle to the transverse edge of the table (FIG. 6). These transverse edge connection receptacles 46 are readily adaptable to other table edges, such as the long edge of the table.

Each table 16, 18 preferably includes at least two connection receptacles 22 so that at least two other tables may be attached. For instance, each of the tables 16, 18 depicted in FIG. 1 include four connection receptacles 22, allowing attachment of one to four additional tables directly to a single table. The attachment of such tables will be discussed in greater detail below.

Figure 8:
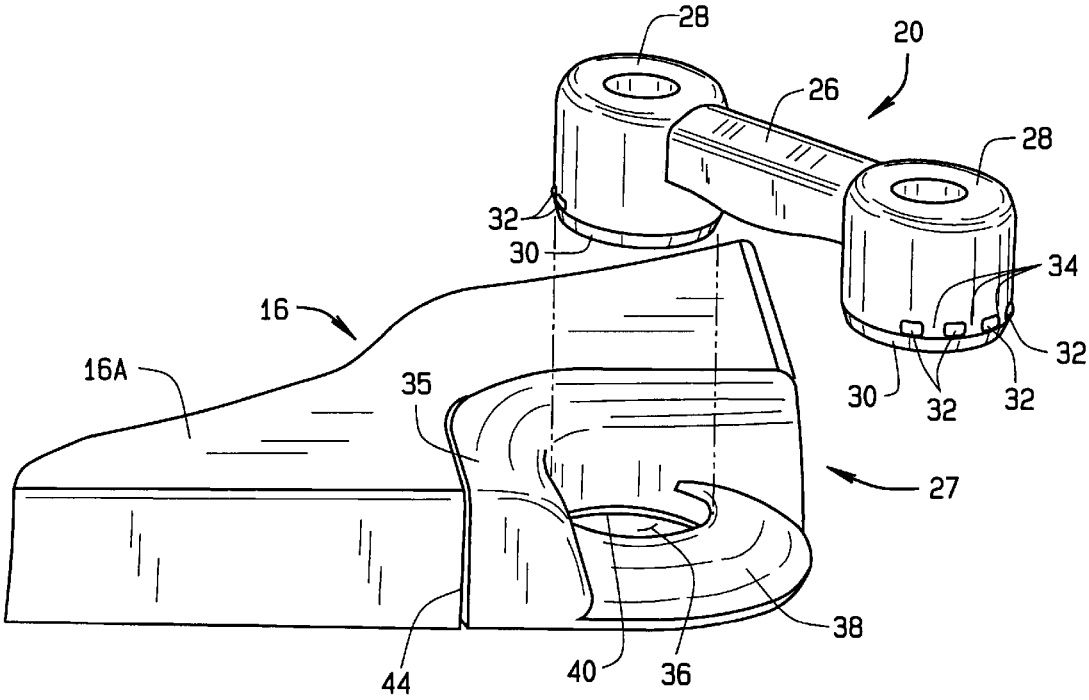
FIG. 8 is a fragmentary perspective of a table corner with the connector exploded from the connection receptacle.
Figure 9:
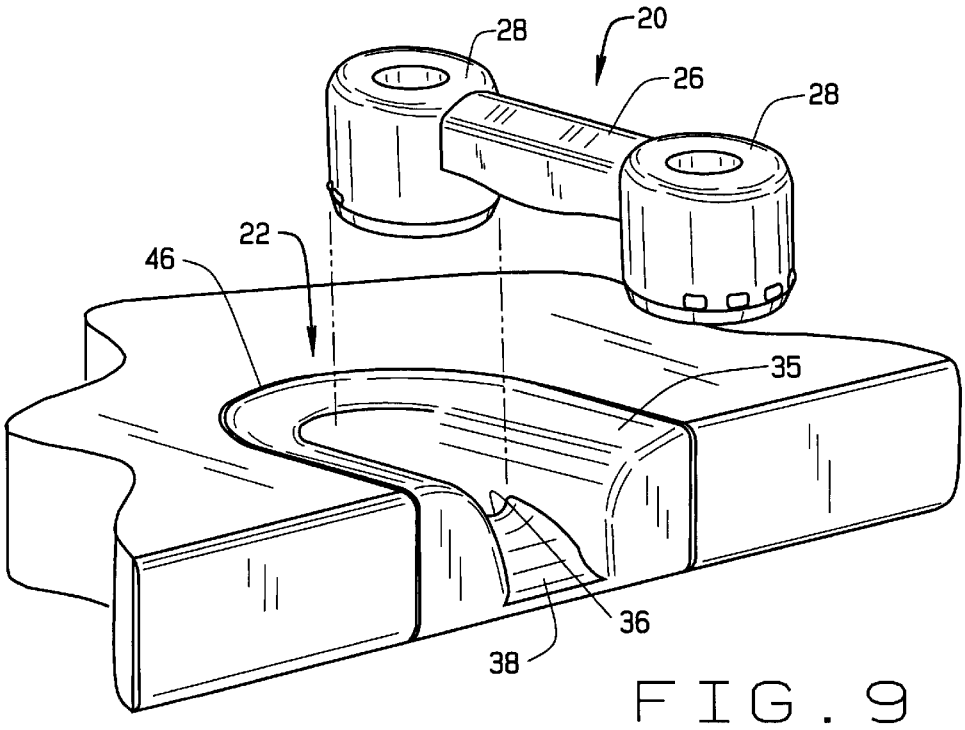
FIG. 9 is a fragmentary perspective of a transverse edge of a table with the connector exploded from the connection receptacle.

In operation, the interconnection system of the present invention allows a user to arrange tables 16, 18 in a variety of positions. The two tables 16, 18 can be brought together so their corners having the corner connection receptacles 44 are adjacent. The connector 20 can be readily inserted so that its end portions 28 are received in the receptacles 44 by a downward movement of the connector into the receptacles. The cross piece 26 is received into a laterally outwardly facing race 38. Thus, the connection can be accomplished in plain view with immediate visual confirmation that the connection has been achieved. When the end portions 28 of the connectors 20 are fully inserted into a connection receptacle, as depicted in FIGS. 7–9, the grooves 40 of the connection receptacles 44 receive the protuberances 32 of the end portions, thereby retaining the end portions from moving upwardly out of the receptacles by an interference fit. Only by application of sufficient upward force to overcome the interference fit can the connector 20 be removed from the receptacles 44.

Even after the connector 20 is inserted, the tables 16, 18 may be pivoted to any number of different orientations without removing the connector. The protuberances 32 and the bosses 42 are sufficiently resilient so that they can deflect and move past one another as the angle of the connected tables 16, 18 changes. Preferably, an audible click can be heard or perceptible vibration can be felt as this happens so that it can be confirmed that a new angular position has been reached. However, depending upon component geometries and materials the audible noise or vibration may not be felt. It will be understood that in the preferred embodiment, the tables 16, 18 may assume several discrete angles relative to each other. However, it is contemplated that the connector 20 may allow the tables 16, 18 to assume any angle relative to each other in a continuous range. A user simply grasps the table 16 and pivots it to the desired position relative to the other table 18. The user enjoys the benefits of a simple and understandable table adjustment system 14. The connection receptacles 22 and connector 20 are at the table surface, in full view of a user, so she is more likely to see and understand the table adjustability. By glancing at the connector 20, a user may readily understand how the tables 16, 18 interconnect and how they might move with respect to one another.

Referring now to FIGS. 10A–10D, the tables 16, 18 are depicted in a sequence of angular positions relative one another. As shown, adjacent tables 16, 18 may pivot without disconnecting the connector 20 from either table. Adjacent tables 16, 18 may readily pivot with respect to one another by direct manipulation of the table, and without manipulation of the connector 20. The user simply grasps the first table (e.g., 16) and pivots it with respect to second table 18. The interference fit between the connector 20 and connection receptacle 22, although strong, is easily overcome by pivoting the table, due to the large moment arm created by the table length. The interference fit ensures that adjacent tables may pivot with respect to one another while the end portions 28 of the connector 20 remain engaged with the connection receptacles 22. The interaction of the protuberances 32 and the grooves 40 further facilitates this strong engagement and interaction, inhibiting the connector 20 from being inadvertently jarred from the receptacle.

Figure 10A:
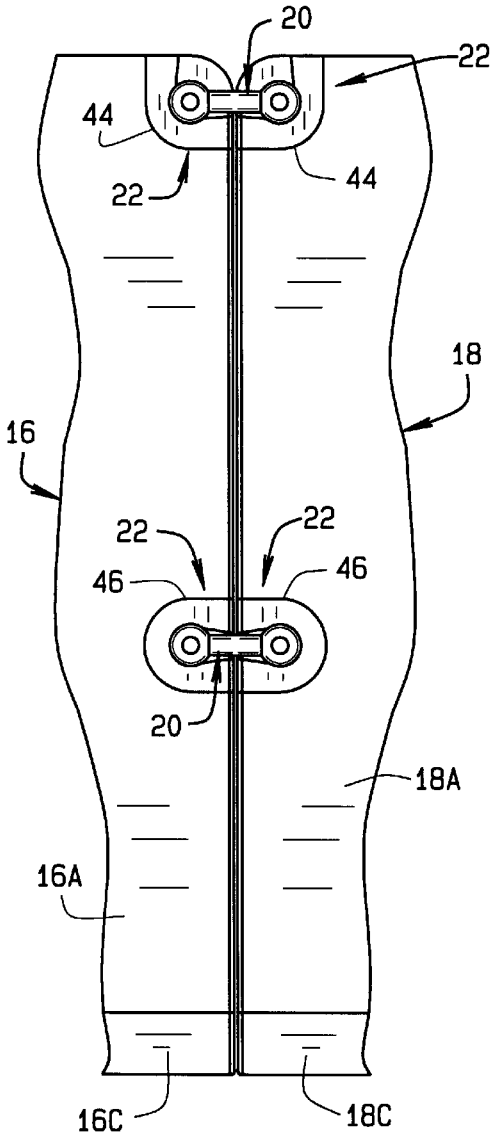
FIGS. 10A–10D are fragmentary plan views of the interconnection system of the present invention where the tables are connected corner-to-corner.
Figure 10B:
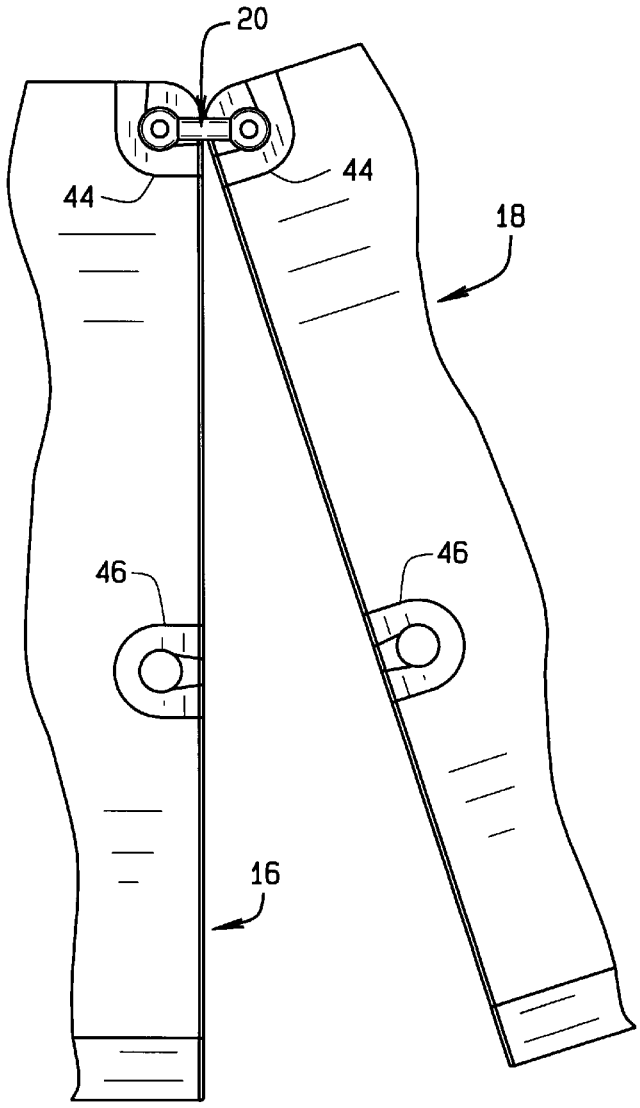
Figure 10C:
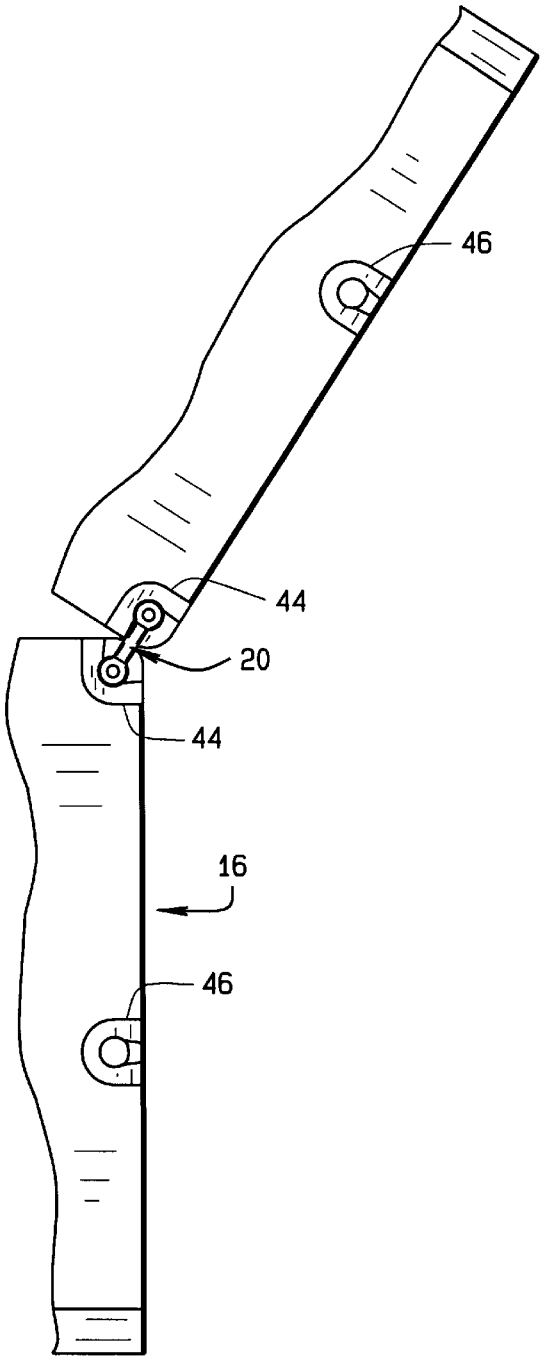
Figure 10D:
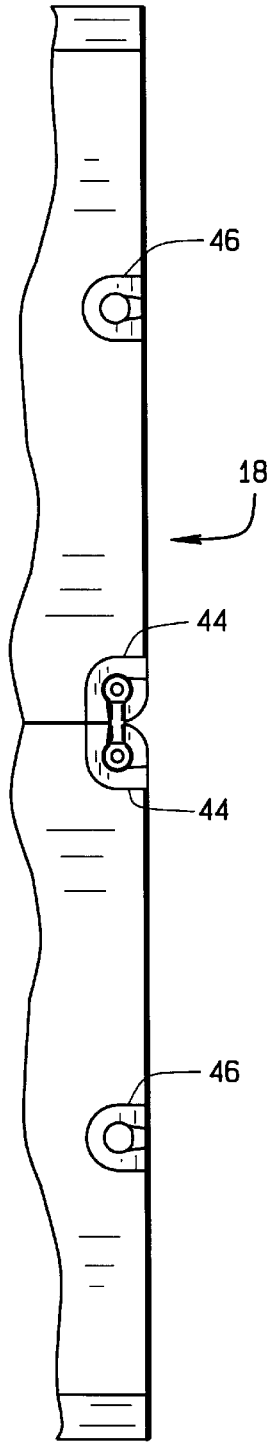
Figure 11A:
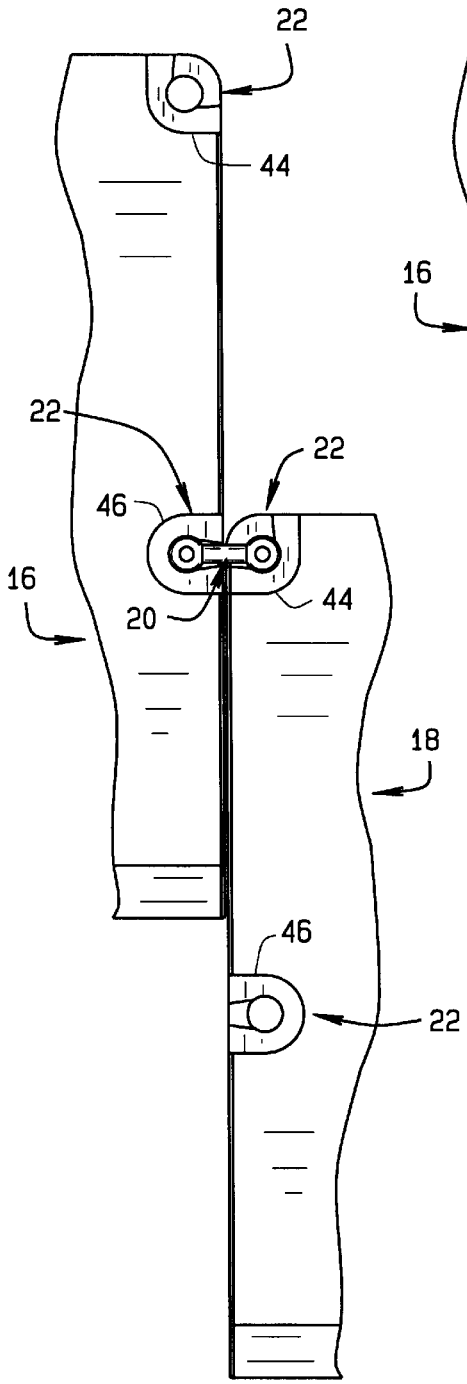
FIGS. 11A–11C are fragmentary plan views of the table system of the present invention where the tables are connected transverse edge-to-corner.
Figure 11B:
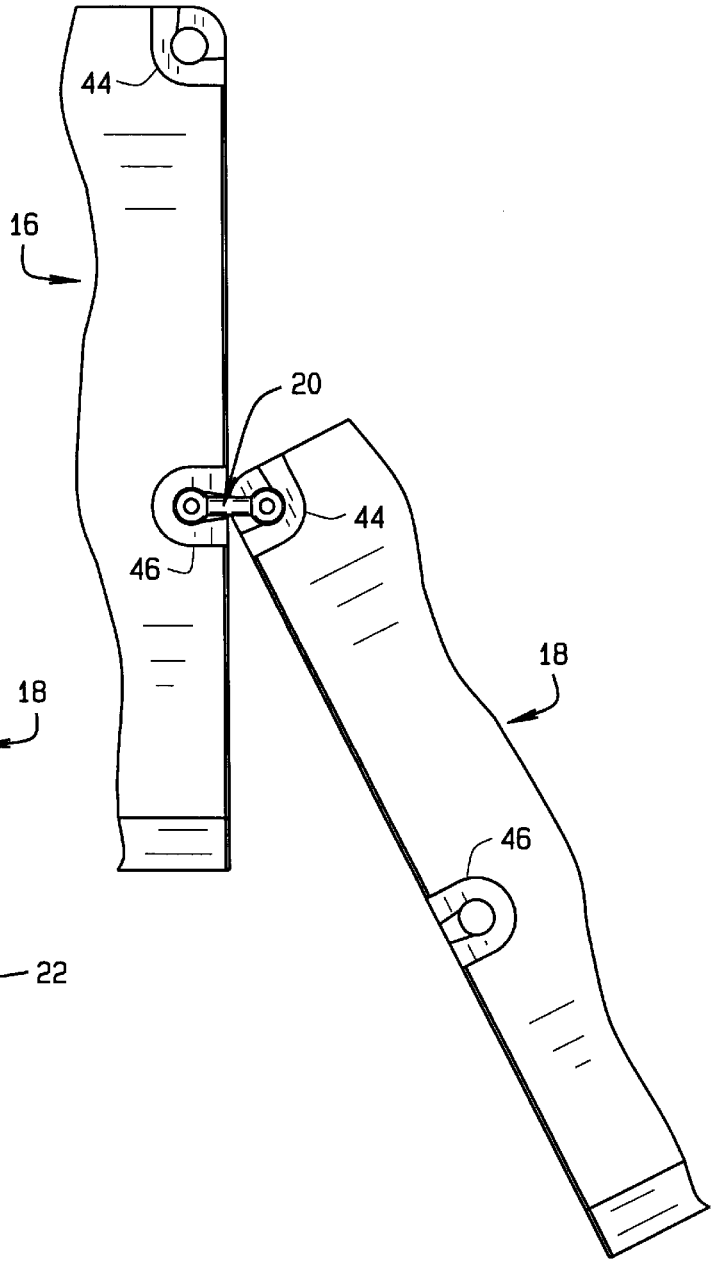
Figure 11C:
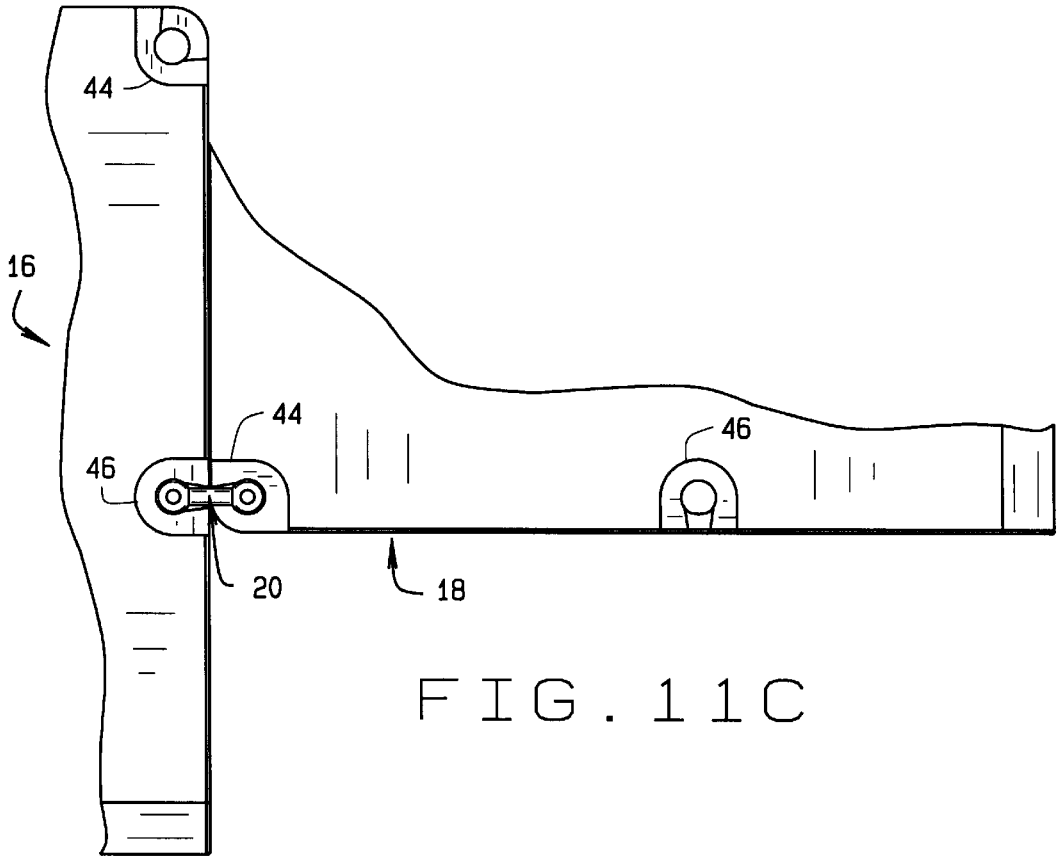

Once the user moves the table to the desired position and angular orientation, the interference fit tends to retain the table and connector 20 in a that orientation. Moreover, the boss 42 of the connection receptacle 22 and recess 34 of the connector 20 cooperate to provide some holding force to retain the tables in the selected orientation. The tables 16, 18 and connector 20 may also be placed at angular orientations not corresponding to the interengagement of a boss 42 with a recess 34 without departing from the scope of the present invention. Thus, two adjacent tables may be adjusted to almost any relative angle to one another. For example, FIG. 10A shows two adjacent tables 16, 18 connected by a pair of the connectors 20 attached in corner connection receptacles 44 and transverse edge connection receptacles 46. By removing the connector 20 seated in the transverse edge connection receptacles 46, the tables 16, 18 are freely pivotable with respect to each other. FIGS. 10B–10D depict the tables 16, 18 as they pivot throughout the motion range of the connector 20. FIGS. 11A–11C depict a similar progression, except that the tables 16, 18 interconnect corner-to-transverse edge, limiting table pivot to ninety degrees.

Figure 12A:
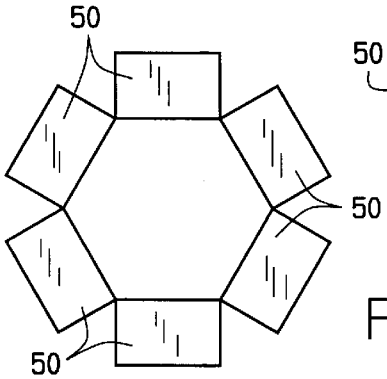
FIGS. 12A–12C are schematic plan views of multiple tables connected according to the present invention.
Figure 12B:
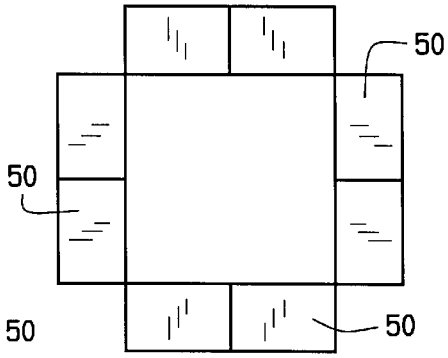
Figure 12C:
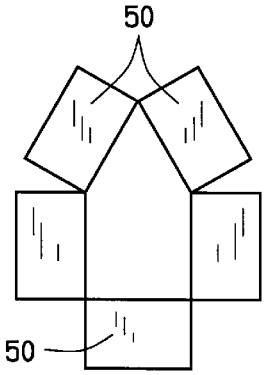

The flexibility of the present invention may be further understood by reference to FIGS. 12A–12C. For instance, multiple tables 50 may join in a generally circuitous path. These tables connect to one another, forming a ring of tables, which may be useful as a meeting room for group discussion. The ring of tables 50 depicted in FIG. 12A is formed by joining six tables, each at their forward corner, and arranging the tables with sixty degree angles between adjacent transverse edges. FIG. 12B shows a similar arrangement, except that the tables 50 interconnect in pairs, transverse edge-to-transverse edge, so eight tables are easily placed in a circuitous path. Table pairs with transverse edges abutting one another are preferably joined by a pair of connectors, one preferably at a corner connection receptacle and the other at an transverse edge connection receptacle of each table. The four table pairs are then joined by four more connectors placed at the forward corners of each of the respective tables. Finally, FIG. 12C shows another configuration of tables 50. These table configurations are examples only, and are not meant to be limiting. Other configurations (not shown) are contemplated as within the scope of the present invention.

For instance, a user can create a grouping of tables disposed in a generally arcuate path, but not a closed loop as described above. By removing one or more tables from the arrangements shown in FIGS. 12A–12C, the tables create an arcuate table arrangement. Such a group may be useful in a classroom atmosphere where multiple tables facing one direction will facilitate viewing a central speaker by each student.

Figure 13:
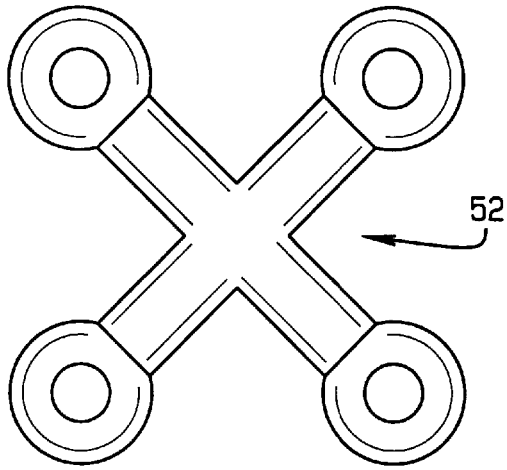
FIG. 13 is a plan view of a cross connector.
Figure 14:
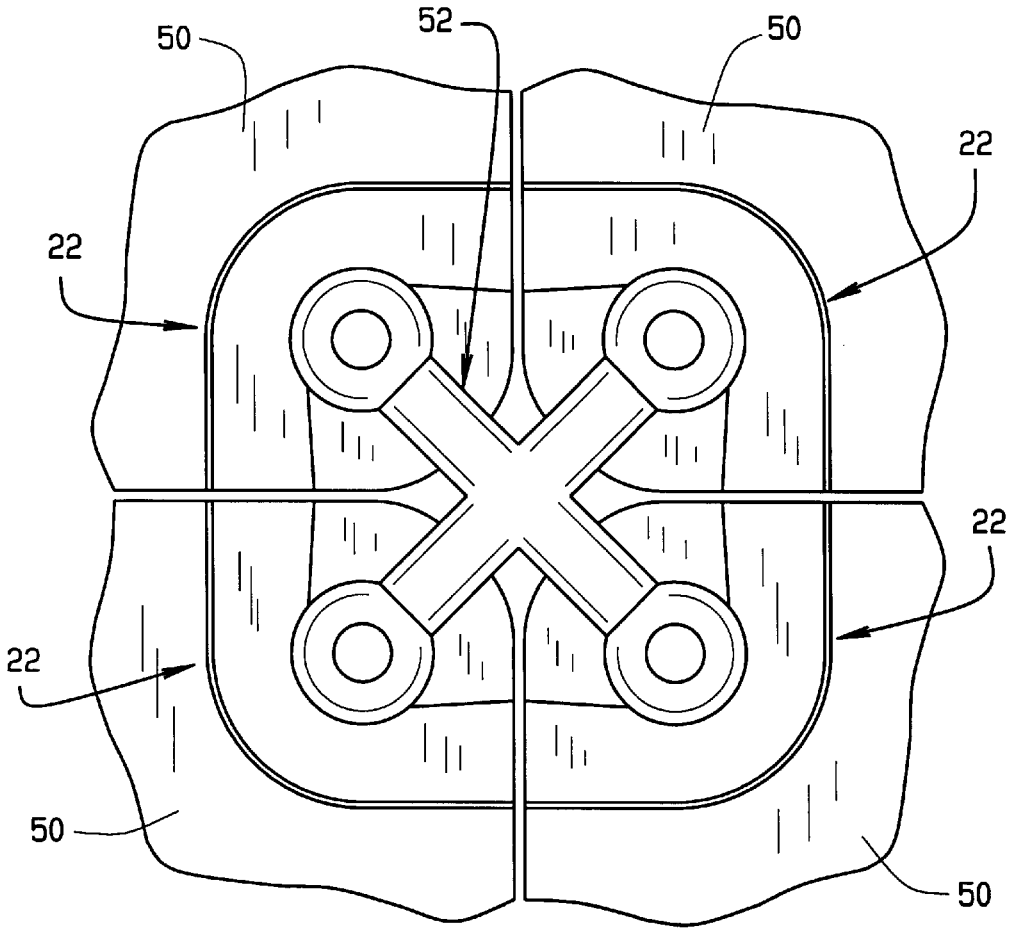
FIG. 14 is a fragmentary plan view of the cross connector joining together four tables.

Finally, the present invention is also directed to a connector including a cross-shaped cross piece 52 and four end portions 28, each at a distal end of a branch of the cross (FIG. 13). Such a connector 52 can join up to four tables at their corner connection receptacles 44 (FIG. 14). Such a connector may be useful in joining several smaller tables together to form a larger table surface.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An interconnectable table system comprising at least two tables, each comprising a table top and a support holding the table top spaced above the floor, the table top providing a work surface and having at least one connection receptacle therein, at least one connector for connecting the tables together, the connector having first and second end portions, each portion sized and shaped for reception in the connection receptacle of a respective one of the tables for connecting the tables together, a cross piece connecting the first and second end portions and extending between the tables, the connector and receptacles are adapted for receipt of the end portions of the connector in receptacles of respective tables at different angles for interconnecting the tables at different angles, and the connector and receptacles being adapted to permit relative pivoting movements of the tables when the connector is received in the receptacles of the two tables.

2. A table system as set forth in claim 1 wherein the receptacle in each table opens upwardly to said work surface of the table top, the end portion of the connector being receivable downwardly into the receptacle through said work surface of the table top.

3. A table system as set forth in claim 2 wherein the connector is free of fixed connection to either of the receptacles.

4. A table system as set forth in claim 2 wherein the connector is visible from a vantage above the work surface of the table top when received in the receptacle of the table.

5. The table system as set forth in claim 1 wherein each receptacle is located at an edge margin of the table top, the receptacle having a laterally outwardly opening portion for receiving said cross piece to permit pivoting movement of the cross piece relative to the table top.

6. A table system is set forth in claim 1 wherein the receptacle of each table is located at a corner of the table.

7. A table system as set forth in claim 6 wherein each table further includes at least one other connection receptacle, said other receptacle being located at an edge margin of the table top away from corners of the table top and adapted to receive one of the end portions of the connector.

8. A table system as set forth in claim 1 wherein the connector is adapted to releasably hold the two tables in plural discrete angular positions.

9. A table system as set forth in claim 1 wherein the receptacle of each table is located at a corner of the table, and each table further includes at least one other connection receptacle, said other receptacle being located at an edge margin of the table top away from corners of the table top and adapted to receive one of the end portions of the connector.

10. A table system as set forth in claim 9 wherein said other receptacles of each table is located along a transverse edge margin of the table generally intermediate two corners of the table top.

11. An interconnectable table system comprising at least two tables, comprising a table the top and a support holding the table top spaced above a floor, the tabletop providing a work surface and having at least one connection receptacle therein, at least one connector for connecting the tables together, the connector having first and second end portions, each portion sized and shaped for reception in the connection receptacle of a respective one of the tables for connecting the tables together, a cross piece connecting the first and second end portions and extending between the tables, the connector being adapted to releasably hold the two tables in plural discrete angular positions, said connector is adapted to permit relative movement of the tables between said discrete angular positions while the end portions of the connector are received in respective connection receptacles of the tables.

12. A table system as set forth in claim 1 wherein said end portions include protuberances and the connection receptacles include an annular groove therein adapted to receive said protuberances for retaining said end portion of the connector in the receptacle in which it is received.

13. A table system as set forth in claim 12 wherein the connection receptacles include bosses located in the annular grooves and receivable between adjacent protuberances of the connector end portions for holding the tables at one of the discrete angular positions.

14. A table connection system comprising a connector, and connector receptacles adapted for mounting in an upwardly facing surface of a table, the connector having end portions, each end portion sized and shaped for reception in one of the connection receptacles upon downward movement of the connector into the proximate receptacle, each connector provided for securing the connection receptacles of a pair of tables together, each connector further comprising a cross piece joining the end portions, the end portions having a greater width than the cross piece, each connector end portion and the connector receptacles are adapted for releasably locking engagement of the end portions in the approximate connector receptacles, the connector end portions are adapted for rotation in said connector receptacles to permit the angle between connected tables to be changed without releasing each connector from its receptacle.

15. A table connection system as set forth in claim 14 wherein the connection receptacles include bosses located in the annular grooves and receivable between adjacent protuberances of the connector end portions for holding the tables at one of the discrete angular positions.

16. A table connection system comprising a connector, and connection receptacles, said connection receptacles adapted for mounting in an upwardly facing surface of a table, the connector having end portions each sized and shaped for reception in one of the connection receptacles upon downward movement of the connector into the approximate receptacle, each connector provided for securing the receptacles of a pair of tables together, each connector further comprising a cross piece joining the end portions, the end portions having a greater width than the cross piece, said connection receptacles comprise a bowl-shaped body having a generally laterally outwardly facing opening adapted to receive a portion of the cross piece of the connector into the receptacle.

17. A table connection system as set forth in claim 16 wherein the generally laterally outwardly facing opening extends over an arc whereby the cross piece is capable of reception through the opening at different angles relative to the connection receptacle for use in connecting tables together at different angles.

18. A table connection system comprising a connector, and connection receptacles adapted for mounting in an upwardly facing surface of a table, the connector having end portions sized and shaped for reception in one of the connection receptacles, the connector comprising a cross piece joining the end portions, wherein the connector end portions and the connection receptacles are adapted for releasably locking engagement of the end portions of connector receptacles provided in at least two approximate tables, whereby at least a pair of tables connected together by said connector may be disposed at different angles for interconnecting the tables at different angles, and whereby the connectors and receptacles permit relative horizontal pivotal movement of the tables when the connector is received in the receptacles of at least two said tables.

* * * * *